US009350104B1

(12) United States Patent
Chen et al.

(10) Patent No.: US 9,350,104 B1
(45) Date of Patent: May 24, 2016

(54) CONNECTOR STRUCTURE WITH RETRACTABLE TERMINAL

(71) Applicant: BELLWETHER ELECTRONIC CORP., Taoyuan County (TW)

(72) Inventors: Kuan-Wu Chen, Taoyuan County (TW); Hsing-Yu Lee, Taoyuan County (TW)

(73) Assignee: BELLWETHER ELECTRONIC CORP., Taoyuan County (TW)

( * ) Notice: Subject to any disclaimer, the term of this patent is extended or adjusted under 35 U.S.C. 154(b) by 0 days.

(21) Appl. No.: 14/805,260

(22) Filed: Jul. 21, 2015

(30) Foreign Application Priority Data

Nov. 10, 2014 (TW) ..... 103138942 A

(51) Int. Cl.
*H01R 13/24* (2006.01)

(52) U.S. Cl.
CPC ..... *H01R 13/2421* (2013.01)

(58) Field of Classification Search
CPC ..... H01R 13/2421
USPC ..... 439/700, 824
See application file for complete search history.

(56) References Cited

U.S. PATENT DOCUMENTS 7,052,330 B2 * 5/2006 Zhu ..... H01R 13/2421 439/635
7,094,112 B2 * 8/2006 Arai ..... H01R 13/2421 439/482
7,914,348 B1 * 3/2011 Lin ..... H01R 12/57 439/700
8,062,078 B2 * 11/2011 Asai ..... H01R 13/2421 439/482
8,337,256 B1 * 12/2012 Lin ..... 439/700
9,004,924 B2 * 4/2015 Kuo ..... H01R 13/6205 439/188
9,263,828 B2 * 2/2016 Kuo ..... H01R 13/6205

* cited by examiner

*Primary Examiner* — Tho D Ta
(74) *Attorney, Agent, or Firm* — Chun-Ming Shih; HDLS IPR Services

(57) ABSTRACT

A connector structure with a retractable terminal includes an insulative main body having a receiving portion and a through hole. A terminal assembly includes a push pin and a connecting terminal, the connecting terminal having a connecting portion, the push pin having a contact portion and an attachment portion, the contact portion protruded out of the through hole, the attachment portion disposed inside the receiving portion; an elastic unit arranged inside the receiving portion and indirectly abutted the push pin protruded out of the through hole; an electrical insulating member covering an outer of the attachment portion of the push pin and disposed between the push pin and the elastic unit for insulation; the electrical insulating member slidably contacts the receiving portion, and a cut-out slot formed on the electrical insulating member, the connecting portion of the connecting terminal penetrating the cut-out slot to electrically contact the push pin.

10 Claims, 7 Drawing Sheets

CONNECTOR STRUCTURE WITH RETRACTABLE TERMINAL

BACKGROUND OF THE INVENTION

1. Field of the Invention

The present invention is related to a mainframe computer, in particular, to a connector structure with a retractable terminal.

2. Description of Related Art

Typically, a retractable terminal is configured at one side of the battery installation space, power supply installation space or the installation space for the electronic component inside an electronic device. Such terminal is mainly used for electrically connecting with the battery or power supply unit and so on in order to provide electricity to the electronic device; or it is used for electrically connecting with the electronic component in order to transmit high frequency signal to the electronic product.

According to a known retractable terminal, it mainly comprises a sleeve, a push pin and a spring. The sleeve is a component made of an insulative material, the push pin and the spring are components made of metal materials. In addition, the push pin is slidably attached to the sleeve, and the spring is installed inside the sleeve to abut against the push pin such that the battery, power supply unit or electronic component is able to form a conductive circuit with the push pin and the spring via pressing the push pin. As result, the electrical power or signal inside the battery, power supply unit or electronic component can be transmitted to the electronic product via the conductive circuit.

However, known retractable terminals are found to be of the following drawbacks: due to the fact that the spring is a helical spring and is a component made of a metal material, it is conductive with the push pin such that the inductance effect can occur when the electricity and signal of the battery, power supply unit or electronic component passes therethrough, which can cause the unfavorable situation of poor transmission due to the influence by the inductance effect when a high frequency electricity of high frequency signal is transmitted therethrough. Furthermore, since the push pin is slidably attached to the sleeve and contacts with the sleeve, under such effect for a long period of time, the push pin made of a metal material is likely to cause the wear out of the sleeve made of an insulative material; consequently, the sliding cooperation between the push pin and the sleeve becomes less stable, which leads to poorer precision for the retractable action of the push pin and affecting the effect of contact thereof.

In view of the above, the inventor of the present invention seeks to provide a reasonable and effective solution of the present invention in light of overcoming the aforementioned drawbacks after years of research and development along with the utilization of theoretical principles.

SUMMARY OF THE INVENTION

An objective of the present invention is to provide a connector structure with a retractable terminal, which uses an electrical insulating member to form an isolation between a push pin and an elastic unit in order to prevent the inductance effect such that the present invention can be used for the transmission of high frequency signal and high frequency electricity while achieving an excellent performance of transmission.

Another objective of the present invention is to provide a connector structure with a retractable terminal, which further uses the aforementioned electrical insulating member to partially cover the push pin in order to drive the push pin to slide via the electrical insulating member such that wear out on the housing caused by the contact between the push pin and the plastic housing can be prevented.

Still another objective of the present invention is to provide a connector structure with a retractable terminal, wherein a cut-out slot is formed on the electrical insulating member such that the aforementioned another objective can be achieved without affecting the conductive contact between the push pin and the terminal.

To achieve the aforementioned objective, the present invention provides a connector structure with a retractable terminal, comprising an insulative main body, a terminal assembly, an elastic unit and an electrical insulating member. The insulative main body includes a receiving portion provided therein, and a through hole formed on a surface of the insulative main body and connected to the receiving portion. The terminal assembly is arranged on the insulative main body and comprises a push pin and a connecting terminal electrically contacted with the push pin; the connecting terminal includes a connecting portion; the push pin includes a contact portion and an attachment portion; the contact portion protrudes out of the through hole; the attachment portion is disposed inside the receiving portion. The elastic unit is arranged inside the receiving portion and is indirectly abutted against the push pin protruded out of the through hole. The electrical insulating member is covered and attached onto an outer of the attachment portion of the push pin and disposed between the push pin and the elastic unit in order to insulate an electrical conduction between the push pin and the elastic unit; wherein the electrical insulating member slidably contacts an internal of the receiving portion, and a cut-out slot is formed on the electrical insulating member, and the connecting portion of the connecting terminal penetrates through the cut-out slot in order to electrically contact with the push pin.

DETAILED DESCRIPTION OF THE INVENTION

The following provides a detailed description on the embodiments and technical content related to the present invention along with the accompanied drawings. However, it shall be understood that the accompanied drawings are provided for illustration purposes only and shall not be treated as limitations of the present invention.

Figure 1:
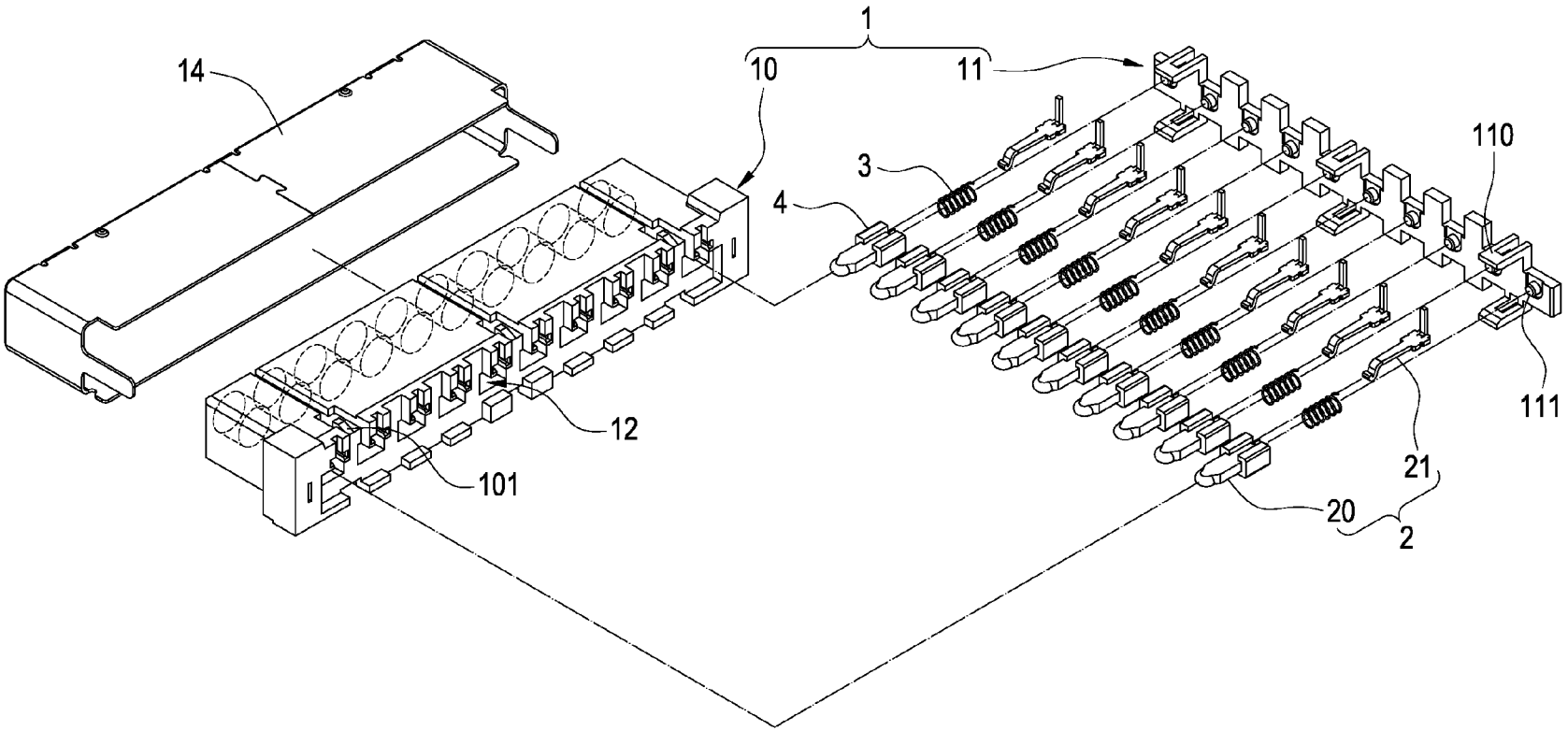
FIG. 1 is a perspective exploded view of the present invention.
Figure 2:
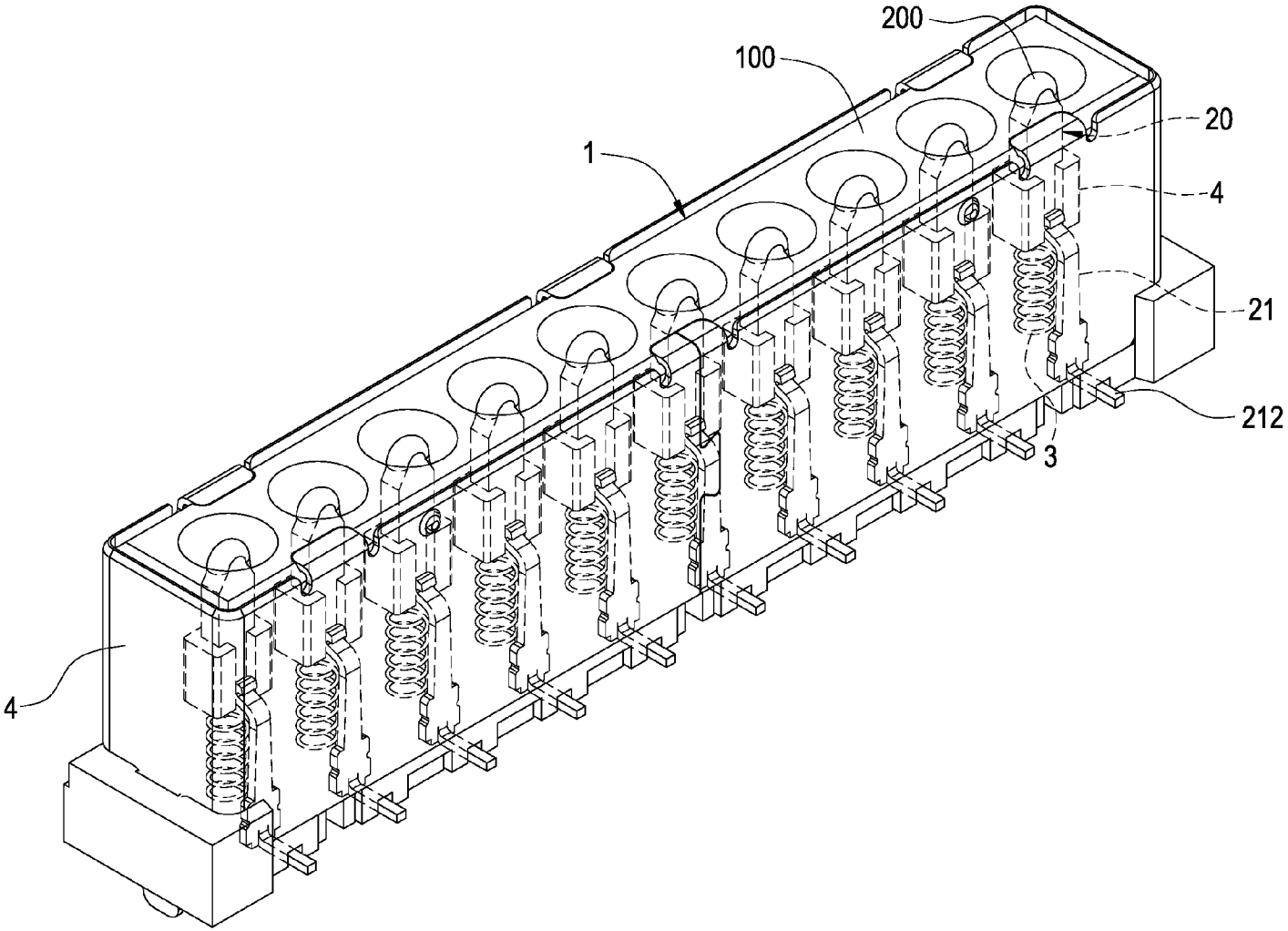
FIG. 2 is a perspective assembly view of the present invention.

Please refer to FIG. 1 and FIG. 2, showing a perspective exploded view and a perspective assembly view of the present invention respectively. The present invention provides a connector structure with a retractable terminal, comprising an insulative main body 1, at least one terminal assembly 2, at least one elastic unit 3 with a quantity corresponding to that of the terminal assembly 2 and an electrical insulating member 4.

Figure 5:
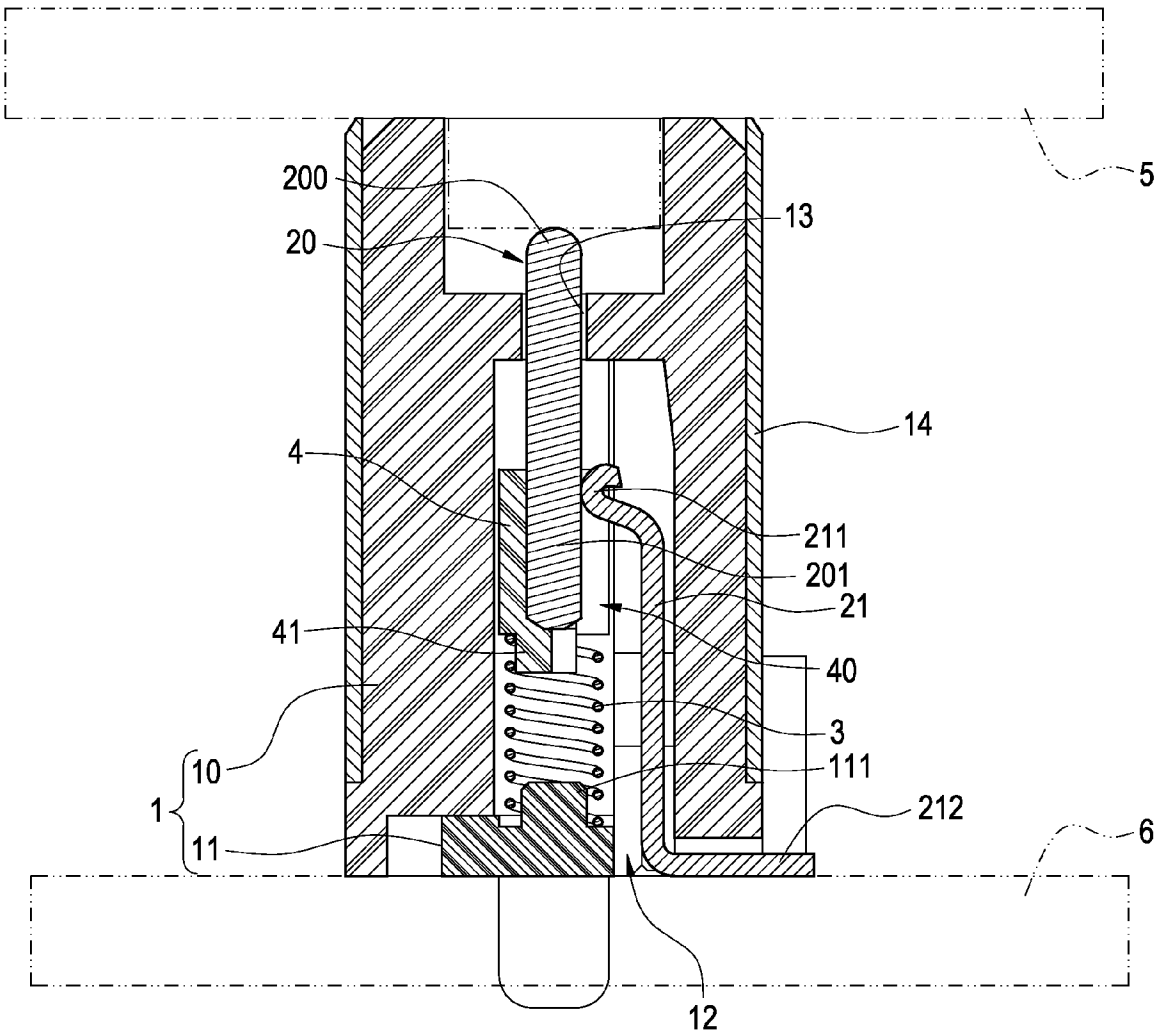
FIG. 5 is an illustration showing a single terminal assembly and the elastic unit of the present invention after the actuation thereof.

Accordingly, the insulative main body 1 is made of an insulation material and provided to allow the aforementioned terminal assembly 2 and the elastic unit 3 installed thereon. In an exemplary embodiment of the present invention, the insulative main body 1 can further comprise an insulative cap 10 and an insulative base 11, and it can also include a corresponding surface 100 facing toward the engagement end 5 (as shown in FIG. 5). The corresponding surface 100 is disposed at the top surface of the insulative cap 10. The insulative cap 10 includes at least one hollow receiving portion 12 formed therein, and at least one through hole 13 connected to the receiving portion 12. The through hole 13 is formed on the insulative cap 10, and the quantities of the receiving portion 12 and the through hole 13 depend on the quantity of the aforementioned terminal assembly 2. Furthermore, the insulative cap 10 and the insulative base 11 are attached to each other in such a way that a plurality of elastic locking members 110 are formed on the insulative base 11 and a plurality of locking slots 101 are formed on the insulative cap 10 correspondingly in order to allow each one of the elastic locking member 110 to be inserted into each one of the locking slots 101 respectively; therefore, the insulative cap 10 and the insulative base 11 can be attached to each other to form the aforementioned insulative main body 1. In addition, the insulative main body 1 can be further covered by a metal housing 14 at an outer thereof.

Figure 3:
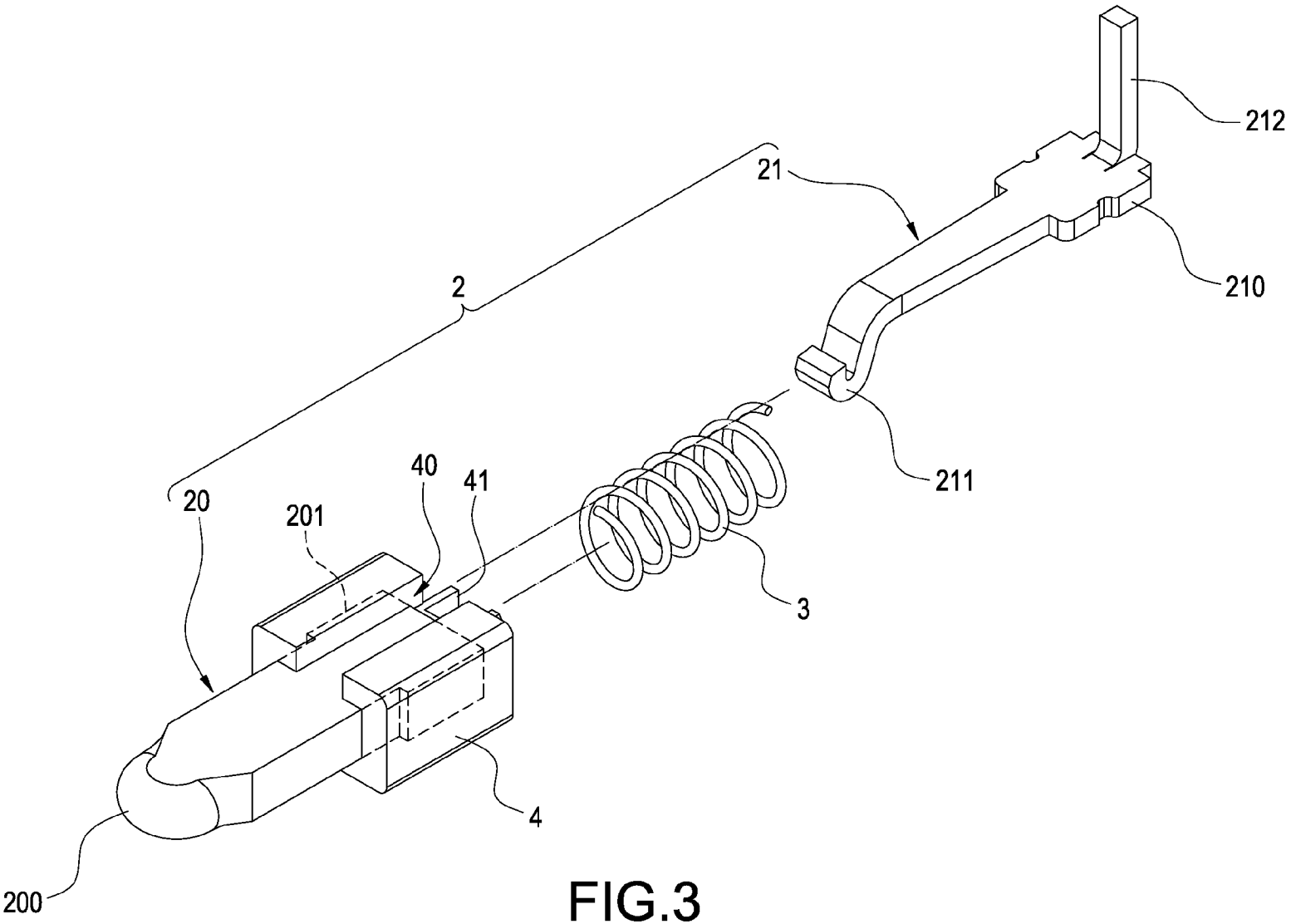
FIG. 3 is a perspective exploded view of the terminal assembly and the elastic unit of the present invention.
Figure 4:
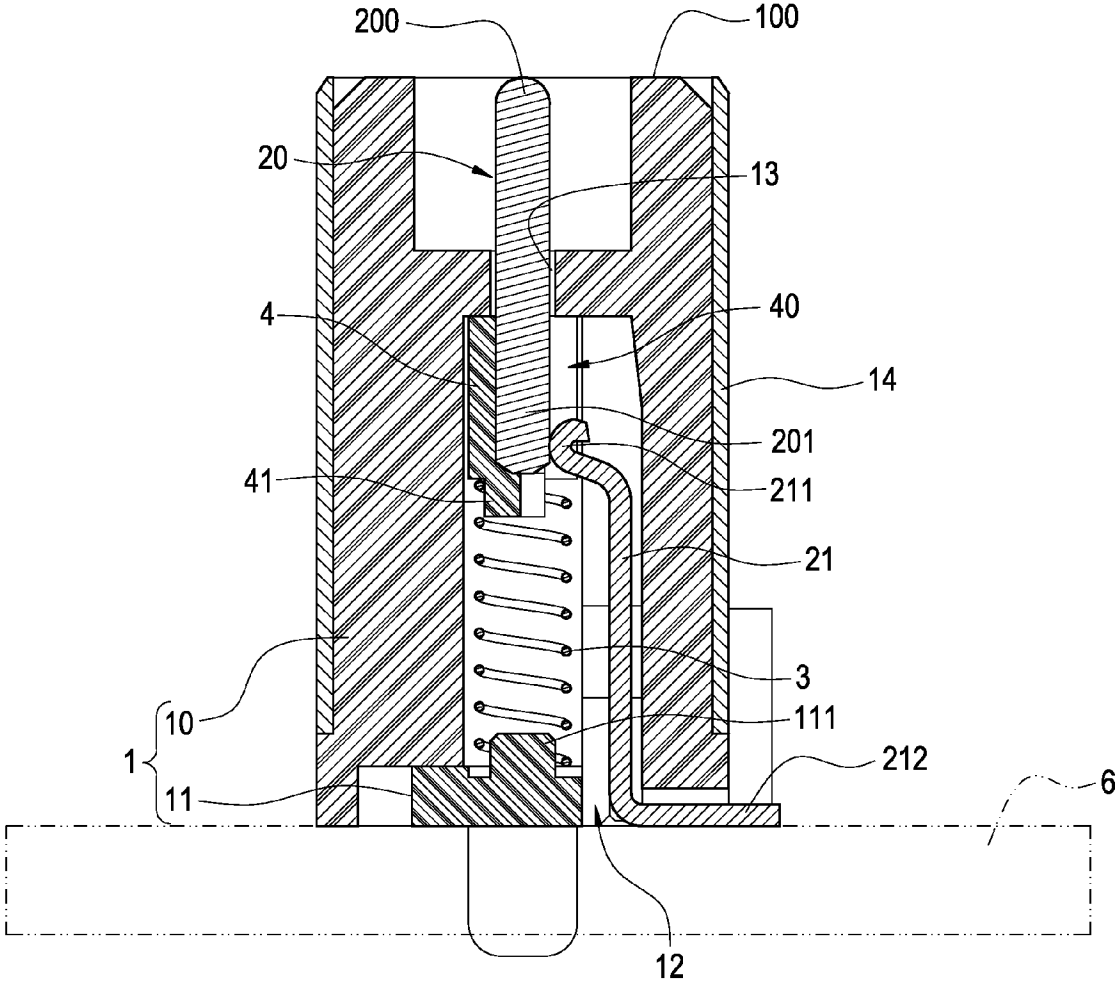
FIG. 4 is an illustration showing a single terminal assembly and the elastic unit of the present invention prior to the actuation thereof.

Please refer to FIG. 3 and FIG. 4. The terminal assembly 2 is made of a conductive material and is arranged on the insulative cap 10 of the aforementioned insulative main body 1 as well as comprises a push pin 20 and a connecting terminal 21 for electrically contacting with the push pin 20. The push pin 20 comprises a contact portion 200 and an attachment portion 201 away from the contact portion 200. The contact portion 200 protrudes out of the through hole 13 of the insulative main body 1, and the attachment portion 201 is disposed at an internal of the receiving portion 12 of the insulative main body 1. The connecting terminal 21 is also disposed inside the aforementioned receiving slot 12 and comprises a securement portion 210, a connecting portion 211 extended from one end of the securement portion 210 and a soldering portion 212 extended from another end of the securement portion 210; wherein the securement portion 210 is provided for the connecting terminal 21 to be firmly secured onto the insulative cap 10 of the insulative main body 1 in order to allow the connecting portion 211 to extend toward the push pin 20 and to contact therewith to form an electrical contact. The soldering portion 212 is adjacent to an outer side of the insulative base 11 and extends from a bottom portion thereof in order to be soldered onto a circuit board 6 (as shown in FIG. 4).

The elastic unit 3 is disposed inside the receiving portion 12 of the aforementioned insulative main body 1 in order to indirectly abut against the push pin 20 of the aforementioned terminal assembly 2 and to allow the contact portion 200 of the push pin 20 to protrude out of the through hole 13 of the insulative cap 10 such that the push pin 20 is able to move back and forth inside the receiving slot 12 along with the elastic unit 3. In an exemplary embodiment of the present invention, the insulative base 11 of the aforementioned insulative main body 1 can be provided with a positioning portion 111 corresponding to the elastic unit 3 and to allow the bottom end of the elastic unit 3 to be mounted onto the positioning portion 111 in order to be positioned thereon.

The electrical insulating member 4 is covered and attached onto an outer of the attachment portion 201 of the push pin 20 of the aforementioned terminal assembly 2 as well as being disposed between the push pin 20 and the aforementioned elastic unit 3. Accordingly, by using the electrical insulating member 4 forming an isolation between the push pin 20 and the elastic unit 3, the push pin 20 and the elastic unit 3 can be prevented from contacting with each other to form an electrical conduction therebetween; such effect is most prominent for situation where the elastic unit 3 is made of a conductive material. In the present invention, the electrical insulating member 4 further includes a cut-out slot 40 formed thereon, and the cut-out slot 40 is configured to cooperate with the moving direction of the push pin 20 moving back and forth on the through hole 13 and to allow the surface of the attachment portion 201 of the push pin 20 to be partially exposed to the external via the cut-out slot 40 such that the connecting portion 211 of the connecting terminal 21 of the aforementioned terminal assembly 2 can penetrate through the cut-out slot 40 to electrically contract with the attachment portion 201 of the push pin 20; therefore, it can be provided to form an electrical contact between the push pin 20 and the connecting terminal 21. In addition, in an exemplary embodiment of the present invention, the electrical insulating member 4 can also include an end portion 41, and the end portion 41 corresponds to the elastic unit 3 such that the top end of the elastic unit 3 can be mounted onto the end portion 41 in order to be positioned thereon. Moreover, the electrical insulating member 4 can be covered and attached onto the outer of the attachment portion 201 of the push pin 20 via a wrapping injection formation method.

Based on the aforementioned structural assembly, the connector structure with a retractable terminal of the present invention can be obtained.

Accordingly, as shown in FIG. 4 and FIG. 5, when the engagement end 5 is used for establishing an electrical connection, it is pressed onto the push pin 20 of the terminal assembly 2; in other words, the push pin 20 and the contact portion 200 are in contact with each other in order to form an electrical connection therebetween. At the same time, as shown in FIG. 5, the push pin 20 moves downward inside the receiving slot 12 due to the pressing by the engagement end 5. Despite the compression exerted on the elastic unit 3, since the electrical insulating member 4 forms an isolation between the push pin 20 and the elastic unit 3, the aforementioned electrical conduction would not be established via the elastic unit 3 (regardless whether the elastic unit 3 is made of a conductive material) but, rather, the electrical conduction is only established at one side of the connecting terminal 21. In addition, since such path of electrical conduction is shorter and direct, the generation of inductance effect can be prevented. As a result, the present invention can be used for the transmissions of high frequency signal or high frequency electricity in order to achieve an excellent performance of transmission. Moreover, with the consideration on factors of the elasticity fatigue of the elastic unit 3 and the possible number of back and forth movement permitted, the elastic unit 3 can be made of any material (including a conductive material) such that the present invention is not limited to the use of any particular material.

Figure 6:
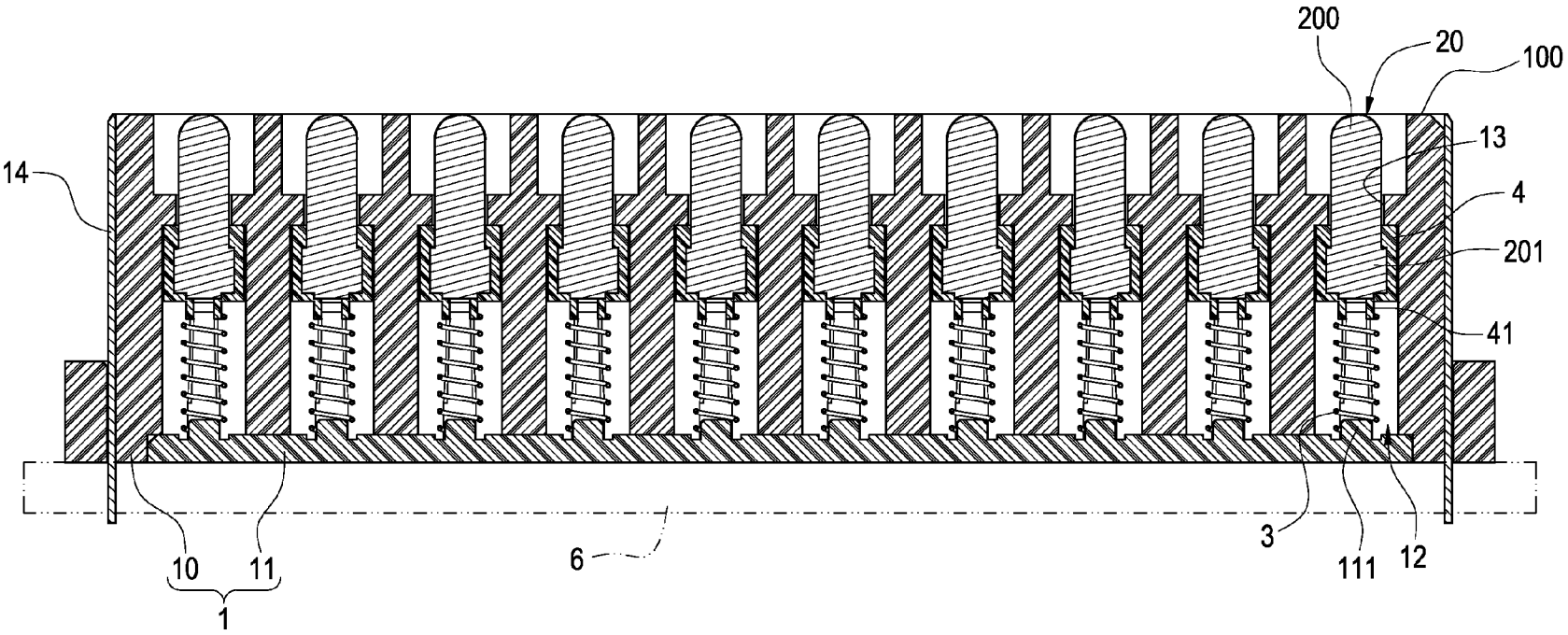
FIG. 6 is a cross sectional view of the assembly viewed from the lateral side of the present invention.
Figure 7:
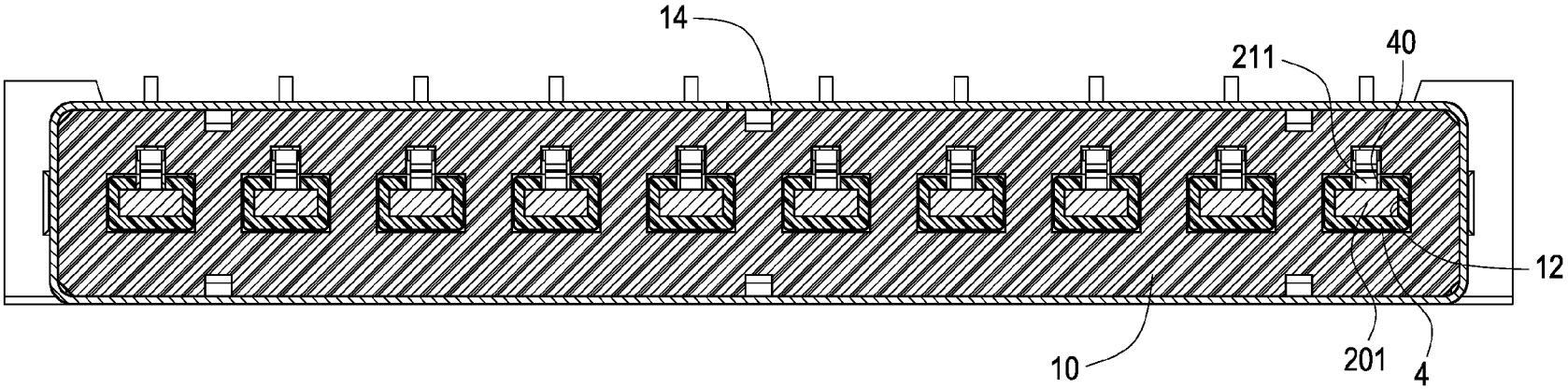
FIG. 7 is a cross sectional view of the assembly viewed from the end surface of the present invention.

Furthermore, as shown in FIG. 6 and FIG. 7, since the aforementioned electrical insulating member 4 is covered and attached onto the outer of the attachment portion 201 of the push pin 20, a sliding contact can be formed between the electrical insulating member 4 and the inner wall of the receiving portion 12 such that by using the sliding cooperation between the electrical insulating member 4 and the receiving portion 12, the upper and lower elastic movement of the push pin 20 can be restricted. As a result, since the electrical insulating member 4 cannot be made of a conductive material, a metal material of a relatively hard structure would not be used for its material but, rather, it can be made of an insulation material, such as plastic. Therefore, it can be made of the same material as that of the insulative main body 1 in order to further reduce the wear caused by the sliding contact while maintaining the precision and stability of the push pin 20 performing the retractable action as well as preventing the effect of contact thereof.

In view of the above, the present invention is able to achieve the objectives expected and overcome the drawbacks of the prior arts. The present invention is of novelty and inventive step while complying with the requirements of patentability. The present invention is legitimately applied accordingly in light of the grant of the patent right for the present application.

It shall be noted that the above description provides preferred embodiments of the present invention only, which shall not be treated as limitation of the scope of the present invention. Any equivalent techniques and technical modifications based on the content of the specification and drawings of the present invention shall be deemed to be within the scope of the present invention.

What is claimed is:

1. A connector structure with a retractable terminal, comprising:

an insulative main body having a receiving portion provided therein, and a through hole formed on a surface of the insulative main body and connected to the receiving portion;

a terminal assembly arranged on the insulative main body and comprising a push pin and a connecting terminal electrically contacted with the push pin, the connecting terminal having a connecting portion, the push pin having a contact portion and an attachment portion, the contact portion protruded out of the through hole, the attachment portion disposed inside the receiving portion;

an elastic unit arranged inside the receiving portion, indirectly abutted against the push pin protruded out of the through hole; and an electrical insulating member covered and attached onto an outer of the attachment portion of the push pin and disposed between the push pin and the elastic unit in order to insulate an electrical conduction between the push pin and the elastic unit;

wherein the electrical insulating member slidably contacts an internal of the receiving portion, and a cut-out slot is formed on the electrical insulating member, and the connecting portion of the connecting terminal penetrates through the cut-out slot in order to electrically contact with the push pin.

2. The connector structure with a retractable terminal according to claim 1, wherein an outer of the insulative main body is covered by a metal housing.

3. The connector structure with a retractable terminal according to claim 1, wherein the insulative main body comprises an insulative cap and an insulative base; the receiving portion is disposed inside the insulative cap, and the through hole is formed on the insulative cap.

4. The connector structure with a retractable terminal according to claim 3, wherein the insulative base includes a plurality of elastic locking members formed thereon, and the insulative cap includes a plurality of locking slots formed thereon correspondingly; each one of the elastic locking members are inserted into each one of the locking slots correspondingly in order to be attached onto each other.

5. The connector structure with a retractable terminal according to claim 3, wherein the insulative base includes a positioning portion corresponding to the elastic unit, and a bottom end of the elastic unit is mounted onto the positioning portion to be positioned thereon.

6. The connector structure with a retractable terminal according to claim 1, wherein the electrical insulating member is covered and attached onto the outer of the attachment portion of the push pin via a wrapping by injection formation method.

7. The connector structure with a retractable terminal according to claim 6, wherein the electrical insulating member and the insulative main body are formed by a plastic material.

8. The connector structure with a retractable terminal according to claim 7, wherein the electrical insulating member includes an end portion, the end portion corresponds to the elastic unit in order to allow a top end of the elastic unit to be mounted onto the end portion in order to be positioned thereon.

9. The connector structure with a retractable terminal according to claim 8, wherein the connecting terminal further comprises a securement portion, and the connecting portion extends from one end of the securement portion.

10. The connector structure with a retractable terminal according to claim 9, wherein the connecting terminal further comprises a soldering portion, and the soldering portion extends from another end of the securement portion.

* * * * *